US007191723B1

(12) United States Patent
Bradford

(10) Patent No.: US 7,191,723 B1
(45) Date of Patent: Mar. 20, 2007

(54) TRANSOM PLUG REMOVAL DEVICE AND METHOD

(76) Inventor: Benny G. Bradford, 523 Browns Ferry Rd., Chattanooga, TN (US) 37419

( * ) Notice: Subject to any disclaimer, the term of this patent is extended or adjusted under 35 U.S.C. 154(b) by 0 days.

(21) Appl. No.: 11/178,103

(22) Filed: Jul. 11, 2005

(51) Int. Cl.
*B63B 13/00* (2006.01)

(52) U.S. Cl. ..... 114/197; 114/221 R

(58) Field of Classification Search ..... D8/82–87; 7/151, 165; 81/901, 121.1, 177.2; 114/221 R, 114/197
See application file for complete search history.

(56) References Cited

U.S. PATENT DOCUMENTS 1,269,413 A * 6/1918 Finnigan ..... 81/177.2
2,750,828 A 6/1956 Wendling
4,089,077 A 5/1978 Morton
4,862,776 A 9/1989 Poling
D309,244 S 7/1990 Reed
5,199,331 A 4/1993 Tsukamoto
5,499,557 A 3/1996 Fry
5,806,380 A 9/1998 Wilsey
6,199,456 B1 * 3/2001 Hlady ..... 81/177.2
6,347,563 B1 * 2/2002 Witt ..... 81/121.1
6,374,707 B1 * 4/2002 Browning ..... 81/119
2006/0260525 A1 * 11/2006 DeHart ..... 114/197

* cited by examiner

*Primary Examiner*—Stephen Avila

(57) ABSTRACT

A transom plug removal device includes a rod that has a first end a second end. A handle is attached to the second end of the rod. A head has an opening therein adapted for receiving a grip of a transom plug. The head is attached to and extends away from the first end of the rod. The grip of the plug is extended into the opening and then rotated with the handle so that the plug is selectively removed or inserted into a transom drain.

5 Claims, 3 Drawing Sheets

TRANSOM PLUG REMOVAL DEVICE AND METHOD

BACKGROUND OF THE INVENTION

1. Field of the Invention

The present invention relates to plug removal devices and more particularly pertains to a new plug removal device for aiding a person in removing a transom plug from or inserting the transom plug into a drain of a recreational boat.

2. Description of the Prior Art

The use of plug removal devices is known in the prior art. U.S. Pat. No. 5,499,557 describes a device adapted for engaging a head of a threaded drain plug for selectively removably of the drain plug. Another type of plug removal device is U.S. Pat. No. 4,862,776 having a clip which is adapted for engaging a head of a drain plug so that it may be removed from a drain. Yet another such device is found in U.S. Pat. No. 5,199,331, which has shape particularly adapted for the removal of vehicle oil pan plugs.

While these devices fulfill their respective, particular objectives and requirements, the need remains for a device that is adapted for removing a transom plug from the transom area of a recreational boat. These boats often have a drain opening for the draining of water accumulated in the boat during recreational activities. The drain plugs are often difficult to reach and grip, particularly since such drain plugs have been moved further under a boat. For this reason, a tool is required which has a unique shape adapted for engaging transom plugs.

SUMMARY OF THE INVENTION

The present invention meets the needs presented above by comprising providing a rod that has a first end a second end. A handle is attached to the second end of the rod. A head has an opening therein adapted for receiving a grip of a transom plug. The head is attached to and extends away from the first end of the rod. The grip of the plug is extended into the opening and then rotated with the handle so that the plug is selectively removed or inserted into a transom drain.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
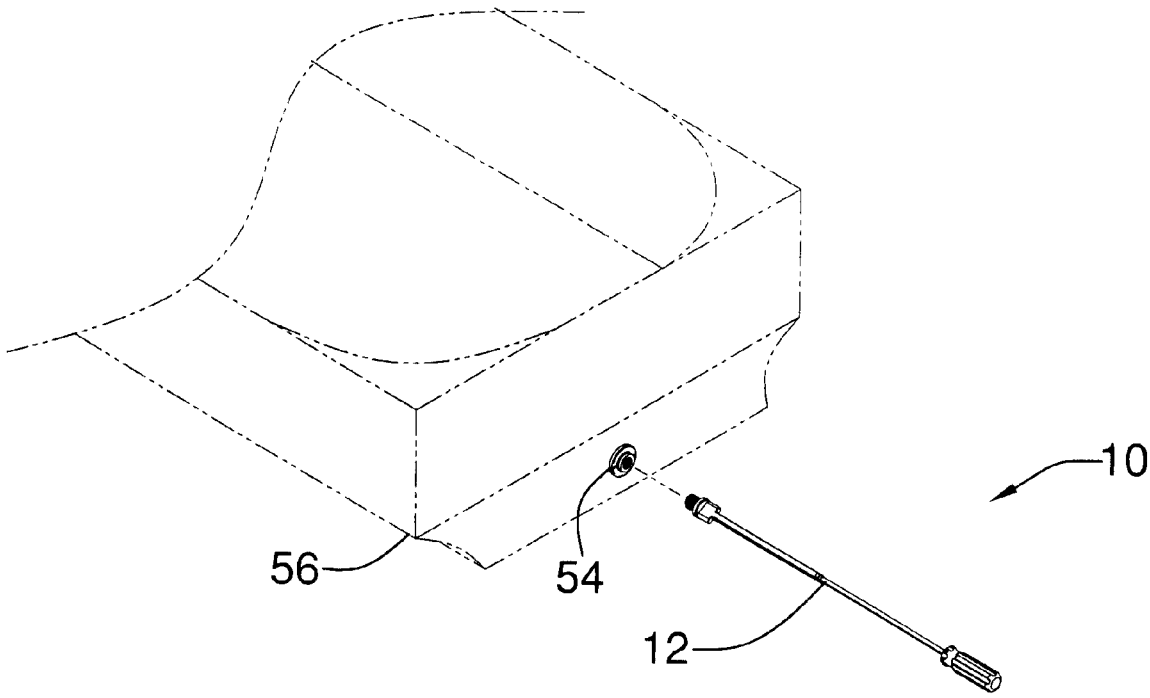
FIG. 1 is a perspective in-use view of a transom plug removal device and method according to the present invention.
Figure 2:
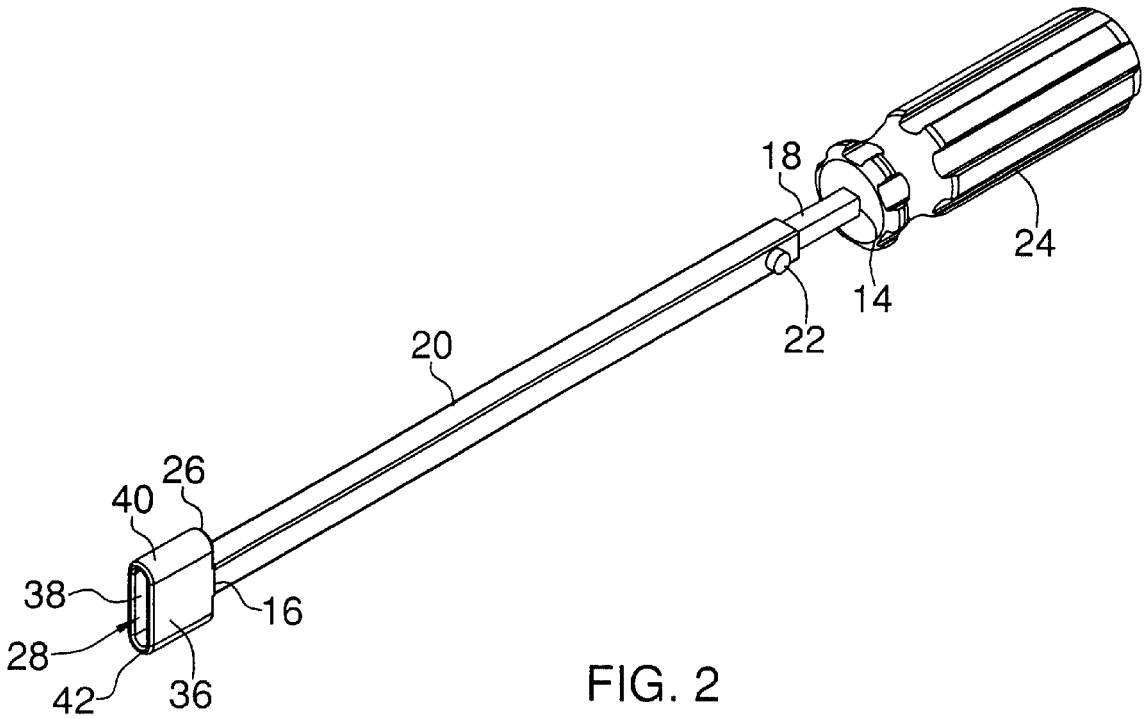
FIG. 2 is a perspective view of the present invention.
Figure 3:
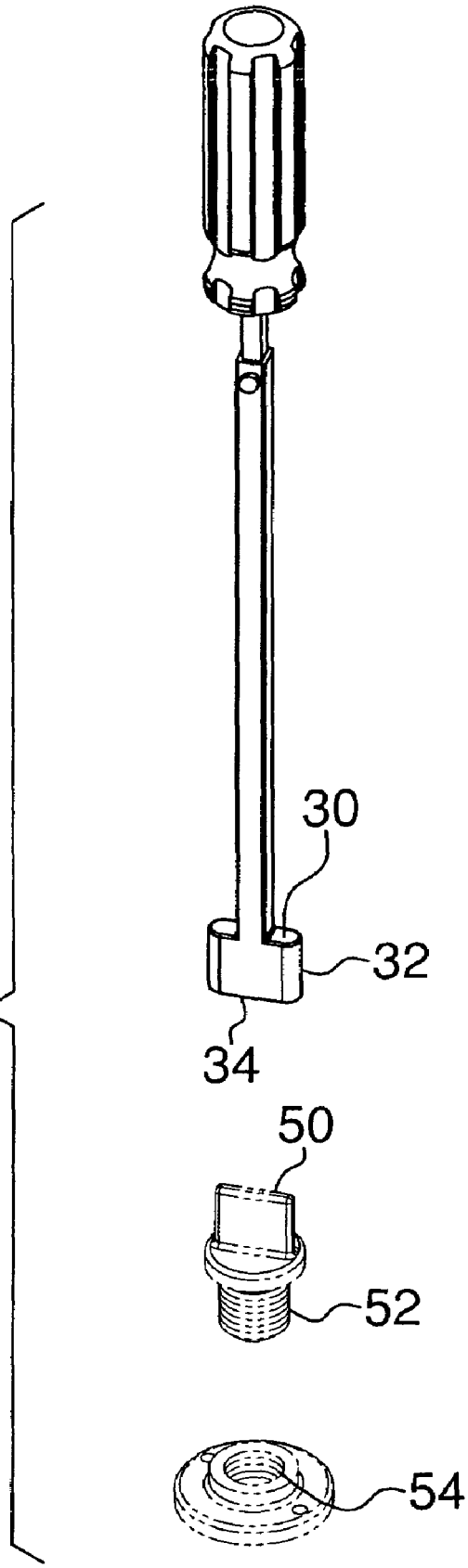
FIG. 3 is a front perspective view of the present invention.

With reference now to the drawings, and in particular to FIGS. 1 through 3 thereof, a new plug removal device embodying the principles and concepts of the present invention and generally designated by the reference numeral 10 will be described.

As best illustrated in FIGS. 1 through 3, the transom plug removal device and method 10 generally comprises a rod 12 that has a first end 14 a second end 16. The rod 12 is telescoping and includes a first portion 18 that is slidably insertable into a second portion 20. A coupler 22 is mounted in the first portion 18 for selectively securing the first portion 18 to a second portion 20 at a selected length. The coupler 22 may include any conventional coupler such as a threaded post. The rod 12 has a length between 8 inches and 20 inches and has a rectangular cross-section. The rectangular cross-section prevents the first 18 and second 20 portions from rotating with respect to each other. A handle 24 is attached to the second end 16 of the rod 12.

A head 26 has an opening 28 therein adapted for receiving a grip 50 of a transom plug 52. The head 26 is attached to and extends away from the first end 16 of the rod 12. The head 26 includes a top wall 30 and a peripheral wall 32 that is attached to and extends downwardly from the top wall 30. The peripheral wall 32 has a bottom edge 34 that defines the opening 28 in the head 26. The first end 16 of the rod 12 is attached to the top wall 30. The peripheral wall 32 includes a first wall 36, a second wall 38, a third wall 40 and a fourth wall 42 wherein the first 36 and second 38 walls are positioned opposite of each other. The third 40 and fourth 42 walls are spaced 15/16 of an inch away from each other. The first 36 and second 38 walls are spaced generally between ¼ inch and ½ inch from each other. Each of the third 40 and fourth 42 walls are arcuate and each has a concave inner surface.

In use, the grip 50 of the plug is extended into the opening 28 and the handle 24 is rotated so that the plug 52 is selectively removed or inserted into a transom drain 54. This device and method will allow for easy removal or insertion of a transom plug 52 positioned in the aft portion of a recreation boat 56.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of removing or inserting a transom plug comprising the steps of:

providing a rod having a first end a second end;

providing a handle being attached to said second end of said rod;

providing a head having an opening therein adapted for receiving a grip of the plug, said head being attached to and extending away from said first end of said rod, said head including a top wall and a peripheral wall being attached to and extending downwardly from said top wall, said peripheral wall having a bottom edge defining said opening in said head, said first end of said rod being attached to said top wall, said peripheral wall including a first wall, a second wall, a third wall and a fourth wall wherein said first and second walls are positioned opposite of each other, said third and fourth walls being spaced 15/16 of an inch away from each other, said first and second walls being spaced generally between ¼ inch and ½ inch from each other; and extending said grip of said plug into said opening and rotating said handle such that said plug is selectively removed or inserted into a transom drain.

2. The method according to claim 1, wherein said rod is telescoping and includes a first portion being slidably insertable into a second portion, a coupler being mounted in said first portion for selectively securing said first portion to a second portion at a selected length.

3. The method according to claim 2, wherein said rod has a length between 8 inches and 20 inches.

4. The method according to claim 1, wherein each of said third and fourth walls being arcuate and having a concave inner surface.

5. A method of removing or inserting a transom plug comprising the steps of:

providing a rod having a first end a second end, said rod being telescoping and including a first portion being slidably insertable into a second portion, a coupler being mounted in said first portion for selectively securing said first portion to a second portion at a selected length, said rod having a length between 8 inches and 20 inches, said rod having a rectangular cross-section;

providing a handle being attached to said second end of said rod;

providing a head having an opening therein adapted for receiving a grip of the plug, said head being attached to and extending away from said first end of said rod, said head including a top wall and a peripheral wall being attached to and extending downwardly from said top wall, said peripheral wall having a bottom edge defining said opening in said head, said first end of said rod being attached to said top wall, said peripheral wall including a first wall, a second wall, a third wall and a fourth wall wherein said first and second walls are positioned opposite of each other, said third and fourth walls being spaced 15/16 of an inch away from each other, said first and second walls being spaced generally between ¼ inch and ½ inch from each other, each of said third and fourth walls being arcuate and having a concave inner surface; and extending said grip of said plug into said opening and rotating said handle such that said plug is selectively removed or inserted into a transom drain.

* * * * *